US006698707B2

(12) United States Patent
Rizo

(10) Patent No.: US 6,698,707 B2
(45) Date of Patent: Mar. 2, 2004

(54) MOULD FOR PRODUCING REVERSE BUILDING MODULES

(75) Inventor: Ricardo S. Rizo, Berga (ES)

(73) Assignee: Innovacions Technologiques, S.A., Barcelona (ES)

( * ) Notice: Subject to any disclaimer, the term of this patent is extended or adjusted under 35 U.S.C. 154(b) by 111 days.

(21) Appl. No.: 10/136,442

(22) Filed: May 2, 2002

(65) Prior Publication Data

US 2002/0170255 A1 Nov. 21, 2002

(30) Foreign Application Priority Data

May 17, 2001 (ES) ..... 200101256

(51) Int. Cl.[7] ..... B28D 7/00
(52) U.S. Cl. ..... 249/91; 249/99
(58) Field of Search ..... 249/19, 35, 40, 249/91, 99; 52/578, 677

(56) References Cited

U.S. PATENT DOCUMENTS 1,219,131 A * 3/1917 Bettermann ..... 249/93
1,579,065 A * 3/1926 Moore ..... 249/99

FOREIGN PATENT DOCUMENTS

EP 0 399 941 * 11/1990

* cited by examiner

*Primary Examiner*—James P. Mackey
*Assistant Examiner*—Donald Heckenberg
(74) *Attorney, Agent, or Firm*—Dickstein, Shapiro, Morin & Oshinsky, LLP.

(57) ABSTRACT

A mould for producing reverse building modules includes a lower horizontal bottom from which longitudinal walls and cross walls are emerging. The cross walls are provided with protrusions inside which respective bars are arranged where the ends of longitudinal rods are disposed defining the framework module. Between each protrusion of the cross walls a spring is provided disposed outside the bars and which ends act on the corresponding ends of the longitudinal bars maintaining the distance therebetween.

2 Claims, 1 Drawing Sheet

MOULD FOR PRODUCING REVERSE BUILDING MODULES

The present application for a patent of invention relates, as stated in its title, to a mould for producing reverse building modules which novel manufacturing, conformation and design features fulfil the purpose to which it has been specifically conceived, with a maximum safety and effectiveness.

There are known reversible building modules which are formed by a generally prismatic body the side walls of which are provided with alternating protrusions. Said protrusions in the module side walls define corresponding recesses which are properly designed to receive the protrusion of an adjacent module thus allowing to engage several modules. The protrusions have a hole intended to house a shaft therein for the relative rotation of a module relative the other one with the purpose of accommodating to the geometry to be covered.

Such modules are provided with a longitudinal reinforcing member arranged at the central part or the module body that ends, at the exposed portion thereof, in a ring matching with the center of said body. This ring allows handling of the module by means of cranes and the like.

The invention provides a new mould for producing this type of building modules, which facilitates the positioning of the framework thereof with a simple and practical configuration, as it will be detailed hereinafter.

The mould of the present invention basically comprises a lower horizontal bottom from which longitudinal walls and cross walls are emerging defining a substantially rectangular cavity into which concrete is to be poured. The mould cross walls are provided with a plurality of protrusions inside which a bar is disposed intended for supporting and fastening longitudinal rods defining the framework. Said bar causes the obtained modules to have a through bore at their protrusions.

The main feature of the mould of the present invention is that between each protrusion in the cross walls a spring is provided arranged outside said bar. The ends of each spring act on the corresponding ends of said framework longitudinal bars. The action of the spring allows maintaining the distance between the framework longitudinal bars.

Due to this feature, the mould enables manufacturing reversible modules with a great comfort since the framework is properly positioned with no need for additional operations, such as welding, to hold the longitudinal bars in position.

According to a further feature of the present invention, the cross walls of the mould have a C-shaped cross section inside which said bar is arranged.

BRIEF DESCRIPTION OF THE DRAWING

Further details and features of the mould of the present invention will be readily understood from the following detailed description of a preferred embodiment thereof. Said description will be given hereinafter by way of a non limiting example relating to the accompanying FIG. 1 corresponding to a diagrammatic top plan view of an embodiment of a mould for producing reverse building modules according to the present invention.

DETAILED DESCRIPTION OF PREFERRED EMBODIMENTS

Figure 1:
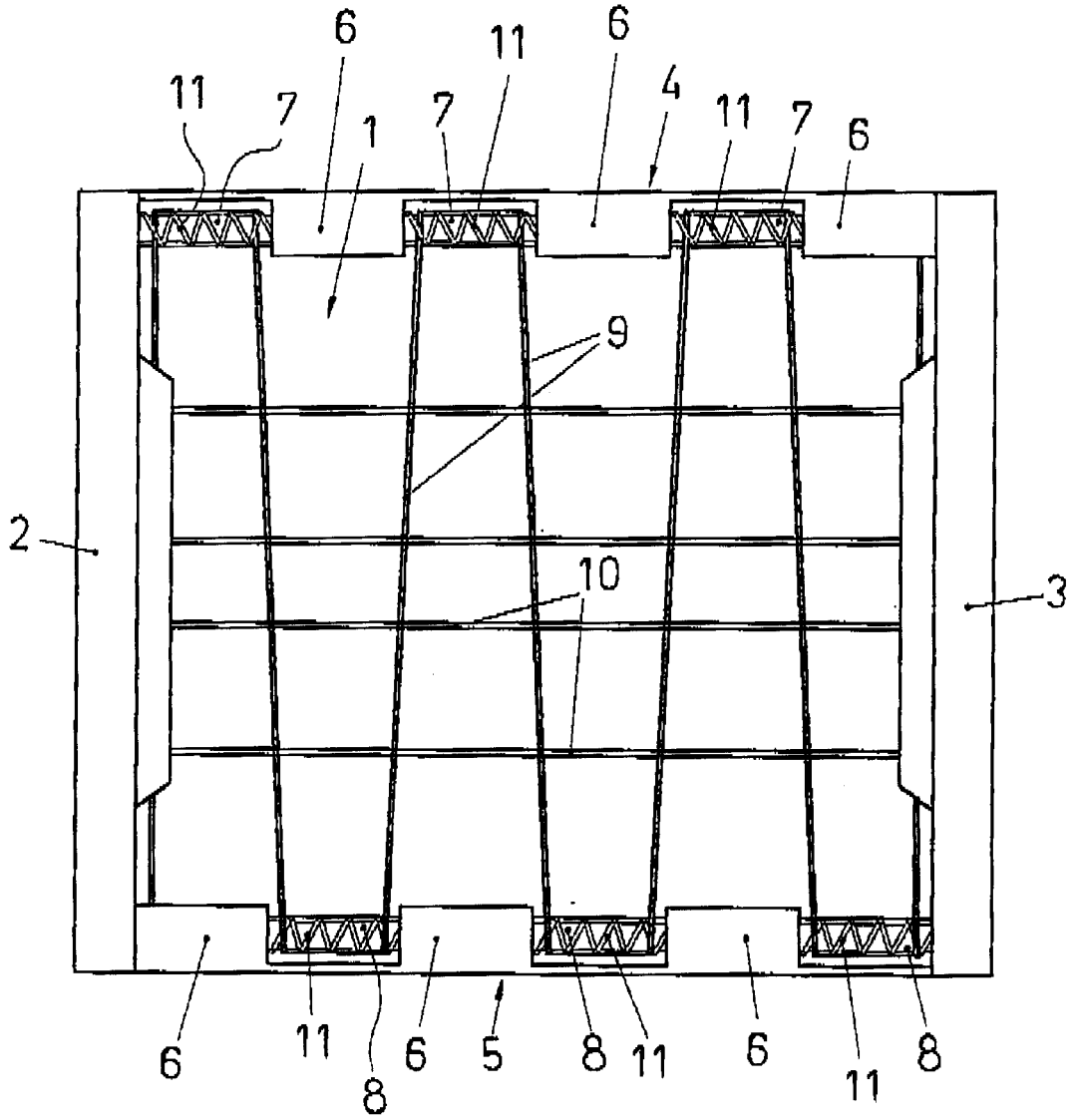

A detailed list of the various parts cited in the present patent application is given below:

(1) metal horizontal bottom;

(2) mould longitudinal wall;

(3) mould longitudinal wall;

(4) mould cross wall;

(5) mould cross wall;

(6) protrusions;

(7, 8) bars;

(9) framework longitudinal bars;

(10) framework cross bars; and

(11) spring.

The mould that is herein described by way of a non limiting example comprises a metal horizontal bottom (1) from which metal longitudinal walls (2, 3) and metal cross walls (4, 5) are emerging defining a substantially rectangular cavity where concrete is to be poured and which setting up will produce a reversible module.

Said mould cross walls (4, 5) are provided, as it can be seen from the attached drawing, with a plurality of protrusions (6) having a prismatic configuration.

Although it has not been illustrated in the drawing, the mould cross walls (4, 5) have a C-shaped cross section and inside them the respective bars (7, 8) are disposed allowing the obtained module to include horizontally holed protrusions so as to safely engage some modules with one another by using a through bar between the protrusions of the modules.

The bars (7, 8) also allow supporting and fastening of longitudinal bars (9) that, together with other cross bars (10), define the framework.

As it can be seen from the drawing, between each protrusion (6) in the cross walls (4, 5) a spring (11) is provided outside each bar (7, 8) the ends of which act on the corresponding ends of the mentioned framework longitudinal bars (9), thus maintaining the distance therebetween. The nodule framework is thereby properly positioned without the need for additional welding operations and the like to hold the longitudinal bars (9) in position.

Materials of the parts in the described mould, as well as shapes and sizes thereof as well as other optional elements can be properly replaced by others which are technically equivalent provided that they will neither depart from the scope of the present invention nor the inventive concept thereof defined in the claims included below.

I claim:

1. A mould for producing reverse building modules comprising a lower horizontal bottom (1) from which longitudinal walls (2, 3) and cross walls (4, 5) are emerging, said cross walls (4, 5) being provided with a plurality of protrusions (6) inside which respective bars (7, 8) are arranged where the ends of longitudinal rods (9) are disposed defining a framework module, characterized in that between each protrusion (6) of said cross walls (4, 5) a spring (11) is provided disposed outside said bars (7, 8) and which ends act on the corresponding ends of said longitudinal rods (9) maintaining the distance therebetween.

2. A mould for producing reverse building modules according to claim 1, characterized in that said cross walls (4, 5) have a C-shaped cross section inside which said bars (7, 8) are provided.

* * * * *